United States Patent [19]

French et al.

[11] 4,315,658

[45] Feb. 16, 1982

[54] MINING EQUIPMENT

[75] Inventors: Albert G. French, Willington; Derek J. Brooks, Ashby-de-la-Zouche, both of England

[73] Assignee: Coal Industry (Patents) Limited, London, England

[21] Appl. No.: 140,751

[22] Filed: Apr. 16, 1980

[30] Foreign Application Priority Data

May 25, 1979 [GB] United Kingdom ..... 18342/79

[51] Int. Cl.[3] ..... E21C 35/22

[52] U.S. Cl. ..... 299/43; 299/12

[58] Field of Search ..... 299/12, 43-47, 299/32, 34; 98/50

[56] References Cited

U.S. PATENT DOCUMENTS

| | | | |
|---|---|---|---|
| 3,014,707 | 12/1961 | Davies | 299/43 |
| 3,700,284 | 10/1972 | Agnew | 299/46 |
| 4,037,875 | 7/1977 | Justice | 299/12 X |
| 4,196,934 | 4/1980 | MacRae | 299/43 X |

FOREIGN PATENT DOCUMENTS

| | | | |
|---|---|---|---|
| 2534005 | 2/1977 | Fed. Rep. of Germany | 299/12 |
| 1098706 | 1/1968 | United Kingdom . | |
| 1301006 | 12/1972 | United Kingdom . | |
| 1437396 | 5/1976 | United Kingdom . | |

*Primary Examiner*—Ernest R. Purser

*Attorney, Agent, or Firm*—Stevens, Davis, Miller & Mosher

[57] ABSTRACT

Mining equipment adapted for repeated traversing to and fro adjacent to a conveyor arranged along a long-wall face in an underground mine, has a mining machine support structure which bridges the conveyor and which has a curtain for guiding airborne dust arising during cutting of mineral by a rotary cutting head mounted on the machine. The air flow passage defined by the curtain has an air flow inducing means therein, such as a fan or water spray.

12 Claims, 6 Drawing Figures

MINING EQUIPMENT

This invention relates to mining equipment.

In particular, although not exclusively, the present invention relates to mining equipment for use with a mining machine which in use repeatedly traverses to and fro winning mineral from a longwall face in a mineral seam in an underground mine, the mining equipment tending to control flow of airborne dust generated during the mineral winning operation.

An object of the present invention is to provide mining equipment which tends to improve dust control in the vicinity of the mining machine.

Accordingly the invention provides mining equipment adapted for repeated traversing to and fro adjacent to a conveyor arrangeable along a working face in an underground mine, the mining equipment comprising a mining machine bridge structure adapted to bridge over the conveyor, means which, in use, enable at least a portion of the bridge structure to traverse along a path spaced from the conveyor, and an airborne dust guide curtain adapted to extend from at least a portion of the bridge structure towards the conveyor.

Preferably, the bridge structure comprises a support structure adapted to carry and/or guide a mining machine having means which, in use, carry a cutter head for winning mineral from the working face.

Alternatively, the bridge structure comprises a mining machine having means which, in use, carries a cutter head for winning mineral from the working face.

Conveniently, at least a portion of the airborne dust guide curtain is mounted on a side of the bridge structure remote from the means for carrying the cutter head.

Advantageously, the airborne dust guide curtain is mounted on at least two sides of the bridge structure.

Advantageously, the air flow dust guide curtain extends outwardly beyond at least one end of the bridge structure.

Conveniently, at least a substantial portion of the guide curtain is rigid.

Preferably, at least a portion of the guide curtain which, in use, is adjacent to the conveyor is flexible.

Preferably, the bridge structure is provided with means for inducing a flow of airborne dust.

Conveniently, the means for inducing the flow of airborne dust comprises a hydraulic nozzle adapted to direct an air flow inducing spray adjacent to the bridge structure.

Advantageously, the means for inducing the flow of airborne dust comprises a driven fan adapted to urge an air flow adjacent to the bridge structure.

By way of example only, two embodiments of the present invention will be described with reference to the accompanying drawings, in which.

Figure 1:
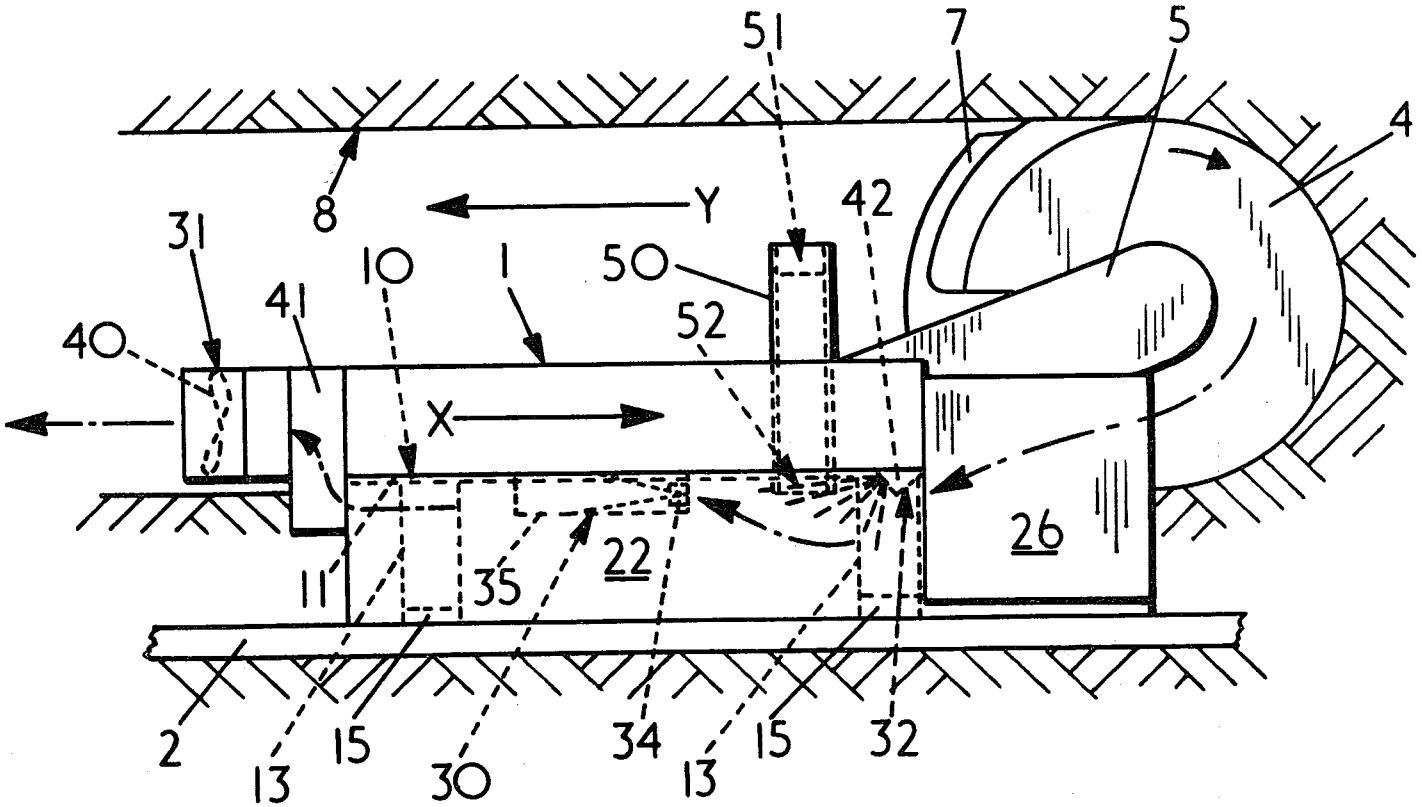
FIG. 1 is a diagrammatic side view of mining equipment constructed in accordance with one embodiment of the present invention.
Figure 2:
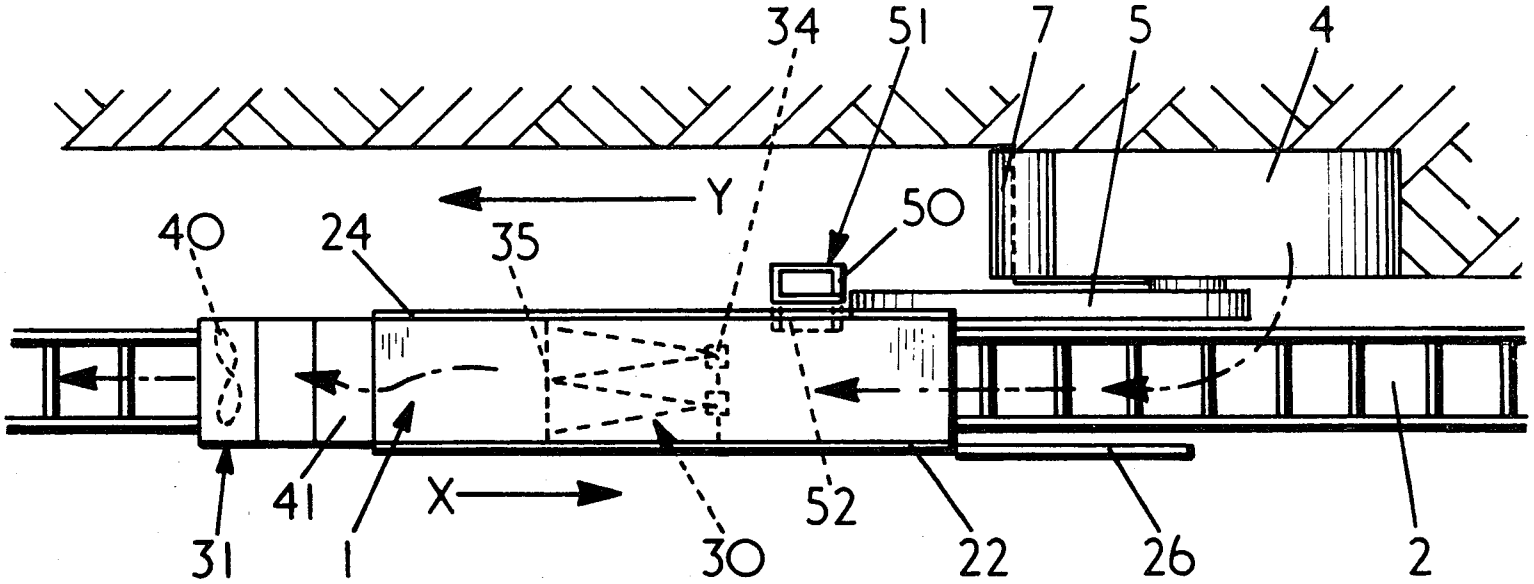
FIG. 2 is a diagrammatic plan of FIG. 1.
Figure 3:
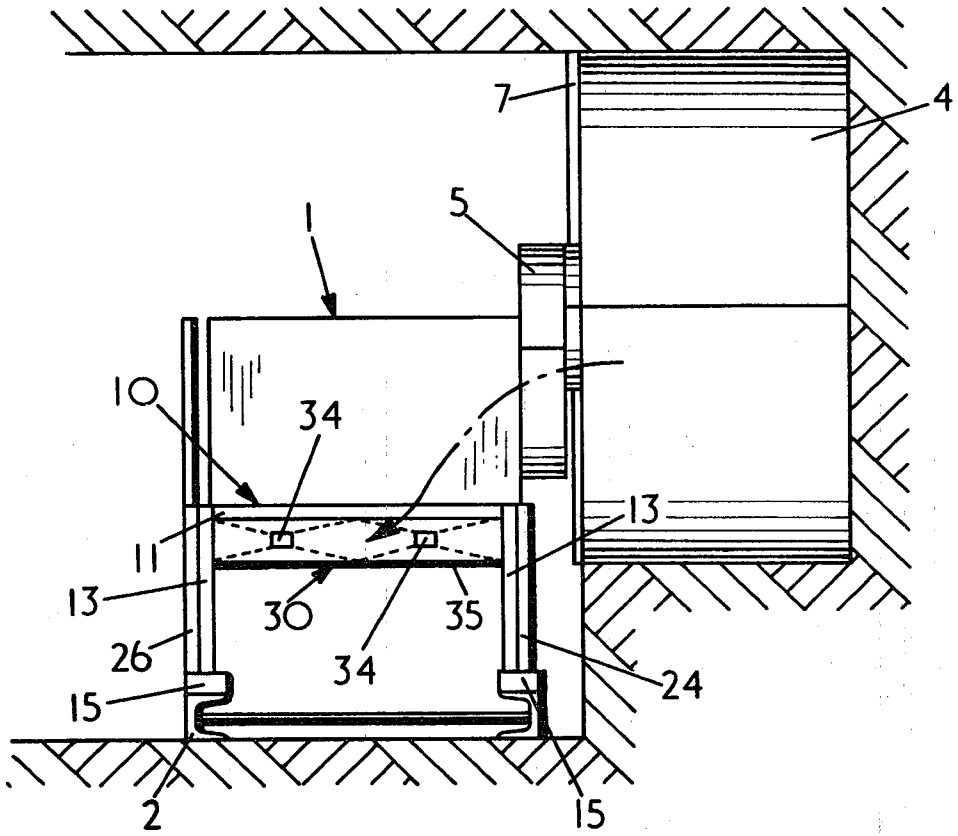
FIG. 3 is a diagrammatic end view of FIG. 1, shown on an enlarged scale.

In FIGS. 1 to 3 of the drawings a ranging drum shearer mining machine 1 is shown mounted on and guided by an armoured flexible conveyor 2 extending along a longwall face in a mineral seam of an underground mine, in operation the machine repeatedly traverses to and fro along the longwall face such that a rotary cutter head 4 carried on an arm 5 wins mineral from the working face. The arm 5 is pivotally supported on the side of the mining machine adjacent to the working mineral face and can be pivotally moved under the action of a hydraulic ram (not shown) to vertically adjust the cutting horizon of the rotary cutter head. A cut mineral loading cowl 7 is provided adjacent to the rear of the cutter head which is shown in an elevated position winning mineral adjacent to the mine roof 8.

In FIGS. 1 and 2 the machine is illustrated moving in a cutting direction indicated by arrows x, opposite to that of the main ventilation air flow as indicated by arrows y. The machine is hauled along a stationary track (not shown) engaged by drive mechanism (not shown) provided on the machine. The drive mechanism may comprise a driven sprocket drivably engaging the stationary track or, alternatively, a reciprocating ram mechanism including means for releasably fixedly engaging the stationary track.

In the drawings the mining machine is shown supported on an underframe bridge structure 10 bridging the conveyor and comprising a support structure having deck plate 11 and two pairs of shoe-carrying legs 13, the shoes 15 being slidably and guidably mounted on upper horizontal flanges of the armoured flexible conveyor 2.

In other embodiments of the invention the mining machine constitutes the bridge structure and no separate support structure underframe is provided.

Two airborne dust guide curtains 22 and 24 are mounted along the two side portions of the support structure 10, the curtains extending downwardly towards the conveyor to define the side walls of an open ended passage extending longitudinally beneath the mining machine. The curtains may be rigid or flexible. In the case of a rigid curtain eg curtains constructed of metal plate it is foreseen that the portion of each curtain adjacent to the conveyor will be flexible or deformable in order to facilitate the machine negotiating undulations in the conveyor.

The guide curtain includes an extended portion 26 extending outwardly beyond the cutting end of the machine, the extended portion tending to guide airborne dust generated by the rotary cutting head during cutting towards the passage defined beneath the underframe support structure and tending to prevent the dust from entering the main ventilation air flow along the face. It will be appreciated from FIG. 2 that the main ventilation air flow tends to assist the flow of airborne dust from the cutting head towards the passage defined beneath the underframe bridge structure.

The mining equipment also comprises means for inducing airborne dust to flow towards the passage beneath the underframe support structure.

FIG. 1 illustrates three separate means 30, 31 and 32 for inducing airborne dust flow, FIG. 2 illustrates two of the means 30 and 31 and FIG. 3 illustrates the means 30. The means 30, 31 and 32 may be used as alternatives. However, in some installations a plurality of the means 30, 31 and 32 may be used in any desired combination depending upon the conditions.

The means 30 is shown mounted within the passage defined beneath the underframe support structure and comprises two water nozzles 34 each mounted within an air flow guide tube 35 and arranged to direct an air flow inducing spray along a path adjacent to, and longitudinally with respect to, the underframe bridge structure. As well as inducing a desired air flow the water powered means 30 tend to wet dust particles entrained in the air flow and thereby tend to suppress dust generated during cutting.

The means 31 is shown mounted on the end of the mining machine remote from cutting end and comprises a driven fan 40 and an enclosed filter panel 41 for removing dust and water particles entrained in the induced air flow. The filter panel includes a layer of filter material which is replaceable. The layer of filter material may be continuously washed to remove dust particles arrested from the air flow.

The means 32 is shown mounted beneath the underframe support structure at a location above the air flow entry to the passage defined beneath the support structure. The means 32 comprises a water spray 42 arranged to direct a spray of atomized water in a direction longitudinally of the support structure and adjacent thereto. In some installations the means 32 may be used to wet the dust laden air prior to it being drawn into the means 31.

The first described embodiment of mining equipment also comprises an air flow guide 50 extending upwards on the side of the mining machine 1 adjacent to the cutter head 4. The air flow guide 50 has an air flow inlet 51 which in FIGS. 1 and 2 is directed towards the working face but which could also or alternatively be directed parallel to the working face.

The air flow guide 50 has an air flow outlet 52 in communication with the passage defined beneath the bridge structure so that in use when an air flow is induced along the passage an air flow is also induced to flow along the air flow guide 50 thus tending to draw airborne dust from the vicinity of the air flow inlet 51 into the passage. The airflow outlet 52 is arranged up stream of the airflow inducing means 30, 31.

In other arrangements a plurality of air flow guides are provided.

In operation as the machine traverses along the face in the direction as shown by arrows x, dust generated by the rotary cutting head is urged towards the passage defined beneath the underframe support structure, the cut mineral loading cowl tending to stop dust flowing to the rear of the cutting head. Thus a substantial portion of the dust generated during cutting passes axially of the rotary cutting head towards the conveying track. The curtain extention tends to retain the flow of dust laden air to within the conveying track from where it is urged by one or other of the means 30, 31 and/or 32 to flow with the induced air flow towards the passage defined beneath the underframe support structure. Within the passage the dust laden air tends to pass through one or other of the means 30, 31 and/or 32 where it is suppressed. Thus the air discharged from the passage defined beneath the support structure back into the main ventilation air flow tends to be relatively free from dust.

It will be appreciated that the guide curtains along the side of the passage tend to control the flow of airborne dust so that substantially all the dust laden air is treated by the means 30, 31 and/or 32.

In other embodiments of the invention only the section of the guide curtain extending along the side of the support structure remote from the cutting head is used, the face side of the passage being left open to allow dust laden air flow to enter the passage along its length.

Figure 4:
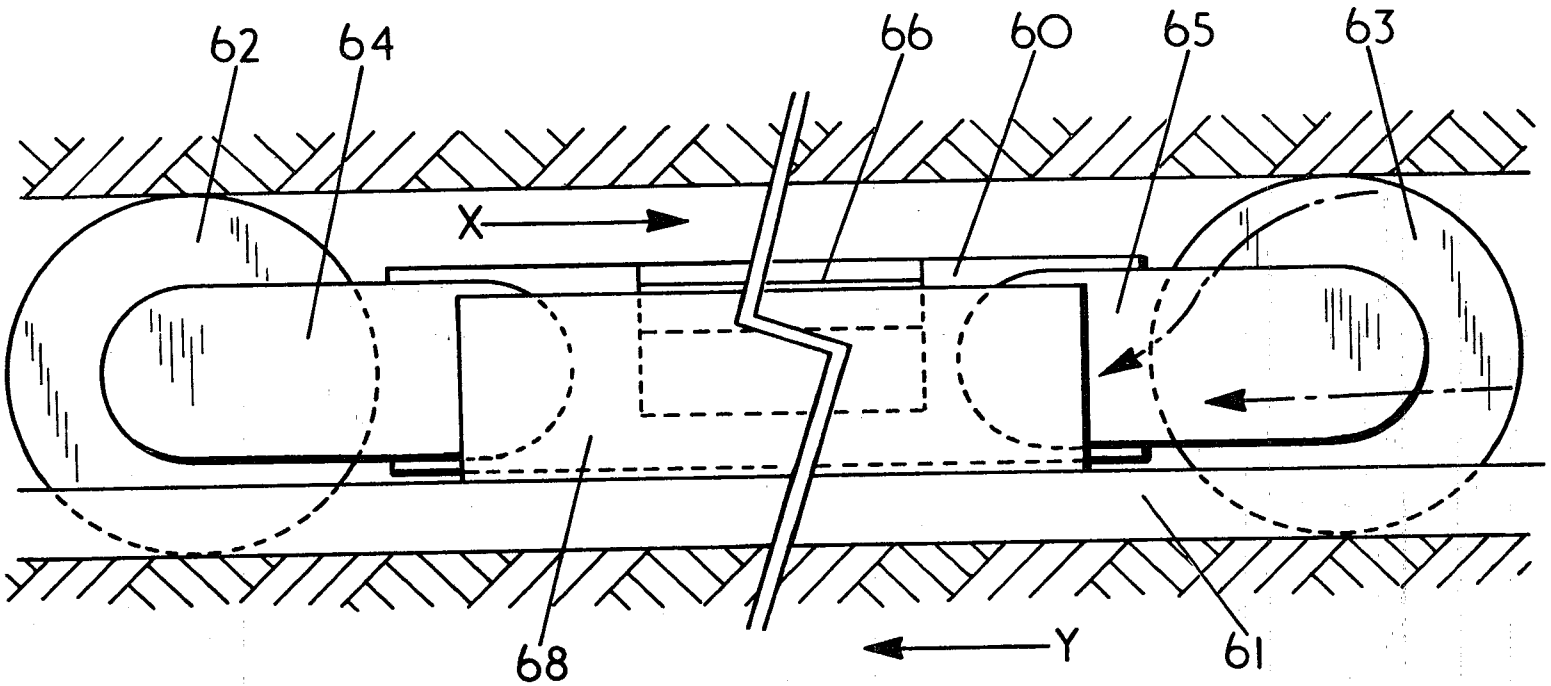
FIG. 4 is a diagrammatic side view of mining equipment constructed in accordance with a second embodiment of the present invention.
Figure 5:
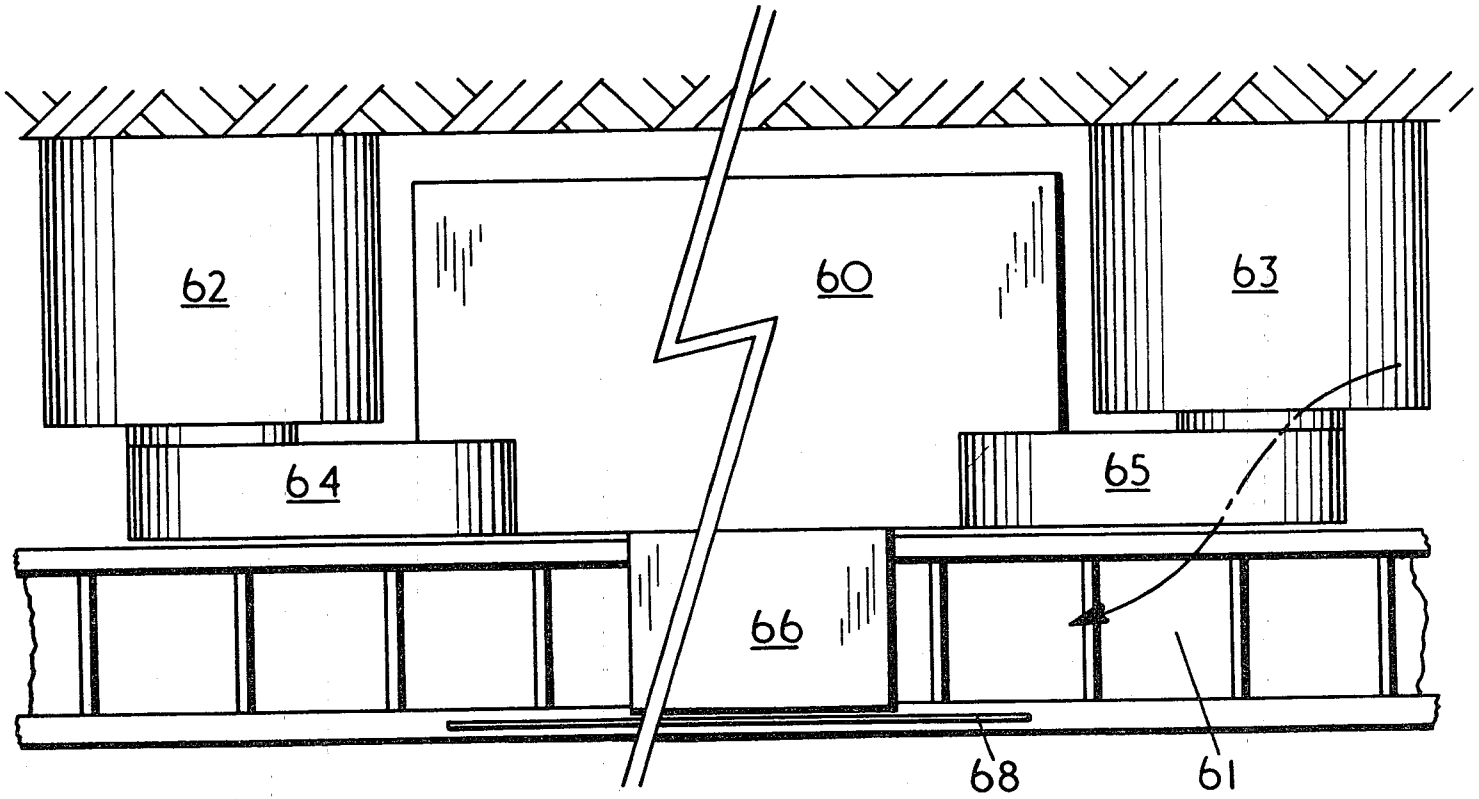
FIG. 5 is a diagrammatic plan of FIG. 4.
Figure 6:
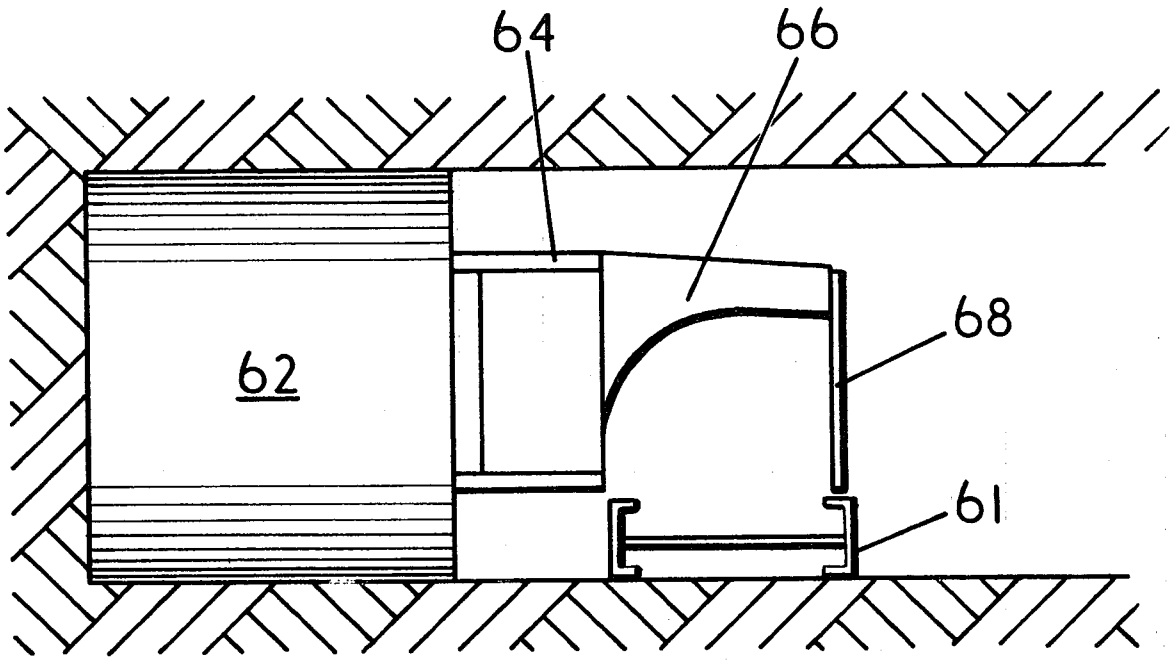
FIG. 6 is a diagrammatic end view of FIG. 4.

FIGS. 4, 5 and 6 show a second embodiment of mining equipment for use with a mining machine 60 arranged to traverse to and fro along the mine floor on the working face side of an armoured flexible conveyor 61. The machine comprises two cutter heads 62 and 63 carried on ranging arms 64 and 65 pivotally adjustable under the action of hydraulic rams (not shown).

The machine body is secured to a bridge structure 66 adapted to bridge the conveyor 61 and to having guide means (not shown) for guidable engagement with the conveyor.

An air flow guide curtain 68 is mounted on the side of the bridge structure remote from the cutter heads, the curtain 68 extending from an upper most portion of the bridge structure towards the conveyor. As shown in FIGS. 4 and 5 the curtain extends beyond both ends of the bridge structure.

The curtain 68 may be of a rigid construction. Alternatively at least a portion of the curtain 68 may be flexible and supported from a rigid portion or section.

The second embodiment of mining equipment also comprises means (not shown) for inducing airborne dust flow into the passage defined by the mining equipment.

In the Figures the machine is travelling in the direction indicated by arrows x. The direction of the ventilation air flow is indicated by arrows y.

We claim:

1. Mining equipment adapted for repeated traversing to and fro adjacent to a conveyor arrangable along a working face in an underground mine, the mining equipment comprising a mining machine bridge structure adapted to bridge over the conveyor, means which, in use, enable at least a portion of the bridge structure to traverse along a path spaced from the conveyor, and an airborne dust guide curtain means extending along and downwardly from opposed side portions of the bridge structure along a major portion of its length and downwardly towards opposed sides of the conveyor to define side walls of an open ended passage extending longitudinally beneath the bridge structure, the curtain means being arranged to negotiate undulations in the conveyor.

2. Equipment as claimed in claim 1, in which the bridge structure comprises a support structure adapted to carry and/or guide a mining machine having means which, in use, carry cutter head means for winning mineral from the working face.

3. Equipment as claimed in claim 1, in which the bridge structure comprises a mining machine having means which, in use, carries cutter head means for winning mineral from the working face.

4. Equipment as claimed in claim 1, in which at least a portion of the airborne dust guide curtain is mounted on a side of the bridge structure remote from the means for carrying the cutter head means.

5. Equipment as claimed in claim 4, in which the airborne dust guide curtain is mounted on at least two sides of the bridge structure.

6. Equipment as claimed in claim 5, in which the airborne dust guide curtain extends outwardly beyond at least one end of the bridge structure.

7. Equipment as claimed in claim 6, in which at least a substantial portion of the guide curtain is rigid.

8. Equipment as claimed in claim 7, in which at least a portion of the guide curtain which, in use, is adjacent to the conveyor is flexible.

9. Equipment as claimed in claim 1, in which the bridge structure is provided with means for inducing a flow of airborne dust.

10. Equipment as claimed in claim 9, in which the means for inducing the flow of airborne dust comprises a hydraulic nozzle adapted to direct air flow inducing spray adjacent to the bridge structure.

11. Equipment as claimed in claim 9, in which the means for inducing the flow of airborne dust comprises a driven fan adapted to urge an air flow adjacent to the bridge structure.

12. Equipment as claimed in claim 1, including filter means within said open ended passage.

* * * * *